United States Patent [19]

Promoli et al.

[11] Patent Number: 4,475,331

[45] Date of Patent: Oct. 9, 1984

[54] SPINNING MACHINE, ESPECIALLY AN OPEN-END SPINNING MACHINE, WITH A PLURALITY OF SPINNING UNITS AND WITH A MAINTENANCE DEVICE MOVABLE ALONG THE MACHINE

[75] Inventors: Johann C. Promoli, Ingolstadt; Rolf Guse, Reutlingen; Sohrab Tabibi, Pfullingen, all of Fed. Rep. of Germany

[73] Assignee: Schubert & Salzer, A.G., Ingolstadt, Fed. Rep. of Germany

[21] Appl. No.: 387,360

[22] Filed: Jun. 11, 1982

[30] Foreign Application Priority Data

Dec. 6, 1981 [DE] Fed. Rep. of Germany ..... 3123281

[51] Int. Cl.[3] ..... D01H 15/00

[52] U.S. Cl. ..... 57/263; 57/264

[58] Field of Search ..... 57/263, 264, 265, 268, 57/271, 300, 301

[56] References Cited

U.S. PATENT DOCUMENTS

| | | | |
|---|---|---|---|
| 3,300,959 | 1/1967 | Fujihara et al. | 57/264 X |
| 3,680,299 | 8/1972 | Lee | 57/264 |
| 3,789,595 | 2/1974 | Bernstein | 57/264 |
| 3,945,183 | 3/1976 | Landwehrkamp et al. . | |
| 4,047,371 | 9/1977 | Stahlecker | 57/264 X |
| 4,080,775 | 3/1978 | Stahlecker | 57/264 X |
| 4,137,699 | 2/1979 | Stahlecker et al. . | |

*Primary Examiner*—Donald Watkins

*Attorney, Agent, or Firm*—Julian W. Dority

[57] ABSTRACT

On a spinning machine, especially an open-end spinning machine, which has a plurality of spinning units (10) each with a plurality of elements (4, 41) to be controlled electrically, there is a maintenance device (2) which is movable along the machine and which can be coupled electrically to the elements (4, 41) to be controlled of the particular spinning unit (10) located in its working range. One bus line (51, 52) is provided for identical elements (4, 41) to be controlled electrically of each of a plurality of spinning units (10). Furthermore, each spinning unit (10) has a switching device (55) which can be actuated as a function of the posiiton of the maintenance device (2) and which connects the various elements (4, 41) to be controlled electrically of a spinning unit (10) to the bus lines (51, 52) which are assigned to them and to which the maintenance device (2) is constantly connected. The bus lines (51, 52) can be connected alternately to evaluation devices (72, 73) located in the maintenance device (2) and to control devices (74, 75, 76).

20 Claims, 4 Drawing Figures

SPINNING MACHINE, ESPECIALLY AN OPEN-END SPINNING MACHINE, WITH A PLURALITY OF SPINNING UNITS AND WITH A MAINTENANCE DEVICE MOVABLE ALONG THE MACHINE

BACKGROUND OF THE INVENTION

The present invention relates to a spinning machine, especially an open-end spinning machine which has a plurality of spinning units, each of which has a plurality of elements to be controlled electrically. A maintenance device is movable along the machine which can be coupled electrically to the elements to be controlled of the particular spinning units located in its working range.

A known device of this type either can be removed from the machine and attached to the machine again on the desired spinning unit or can be displaced on rails along the machine. The device is electrically connected at the desired spinning unit by means of a plug to the elements to be controlled (German Auslegeschrift No. 2,351,458). This device has to be brought by hand to the spinning unit to be maintained and also works by manual control. Furthermore, this device is also very complicated to handle because of the electrical connection to be made in each case by means of the plug and to be broken again subsequently.

Fully automatic maintenance devices are also known, and these travel along the machine and detect a thread sensor which has fallen off because of a thread break, whereupon the maintenance device stops at the particular spinning unit (German Offenlegungsschrift No. 2,714,353). The maintenance device possesses one signal receiver and one control transmitter, to which are respectively assigned correspondingly a control transmitter and a signal receiver of the spinning unit. These control connections, which can also be replaced by plug connections, have to be made anew at each spinning unit.

SUMMARY OF THE INVENTION

The object of the present invention is to provide a device which permits simple and reliable electrical coupling between a maintenance device movable along the spinning machine and the spinning unit to be maintained.

This object is achieved, according to the invention, due to the fact that there is one bus line for identical elements to be controlled electrically of each of a plurality of spinning units and there is for each spinning unit a switching device which can be actuated as a function of the position of the maintenance device. The switching device connects the various elements to be controlled electrically of a spinning unit to the bus lines which are assigned to them and to which the maintenance device is constantly connected. Because the movable maintenance device is constantly connected to the bus lines on the machine side, neither complicated releasable plug connections nor contactless transmitter and receiver devices for each spinning unit are necessary. Instead, a switching device, which is provided for each spinning unit and which can be actuated as a function of the position of the maintenance device, connects in a simple way the individual elements of a spinning unit at the required moment in time to their bus lines and consequently also to the maintenance device. In this way, there is no need for the contact connections or even contactless connections which have had to be made for each spinning unit hitherto between the spinning unit and the maintenance device, as a result of which substantial simplification of the control device and control transmission is achieved, while maintaining the same accuracy.

According to a further feature of the invention, a further simplification of the subject of the invention is achieved due to the fact that the bus lines can be connected alternately either to evaluation devices located in the maintenance device or to control devices. It is possible, in this way, to sense and evaluate the working state of an element via a specific bus line and, if required, transmit a control command for a specific job of the particular element. As a result, there is no need for separate devices for sensing and controlling an element because the desired mode of working of the corresponding element can be brought about by a change in the sensed signal.

Appropriately, the maintenance device possesses for the switching devices of the individual spinning units an actuating device which advances before it in the direction of movement and enables prompt stopping of the maintenance device and reliable maintenance in spite of inertia of the maintenance device. Linking the maintenance device to the desired spinning unit is guaranteed, even when the maintenance device travels along the individual spinning units of the spinning machine normally, that is to say when there are no faults, without interrupting its travel. When it is intended that the maintenance device should not or not merely circle the machine, there is advantageously for each direction of movement a leading actuating device of this type, and these can be alternately put into operation and out of operation as a function of the change in direction of the maintenance device.

So that it is not necessary to provide a memory which stores the signals sensed, at the spinning unit to be maintained, by actuating the switching device by means of a leading actuating device of this type, until the maintenance device has assumed its final working position at the particular spinning unit, it is envisaged, according to a further feature of the invention, that the maintenance device should have, in addition to the leading actuating device, a further actuating device for the switching devices which is activated in the working position of the maintenance device.

The subject of the invention requires, irrespective of the number of spinning units, only a single transmission point between the machine and the maintenance device and between the maintenance device and machine, and moreover this is never interrupted. This results in a simple solution, not susceptible to faults, for the individual control of a spinning unit as a function of faults arising there by means of a single maintenance device movable along the spinning machine. The necessary connection of this maintenance device is effected, controlled from the latter, by actuating a switching member provided on the spinning unit, and this can be carried out in a simple way by contact or even with no contact. In contrast to the state of the art, the sensing period can be increased in a simple way by simply giving the actuating device (control cam, switching lug for a contactless switch) appropriately large dimensions. As a result, the state of the individual spinning units can be sensed while the maintenance device is moving along the machine at a relatively high speed.

Further details and advantages of the invention emerge from the following description and from the attached drawings in which:

DESCRIPTION OF A PREFERRED EMBODIMENT

Figure 1:
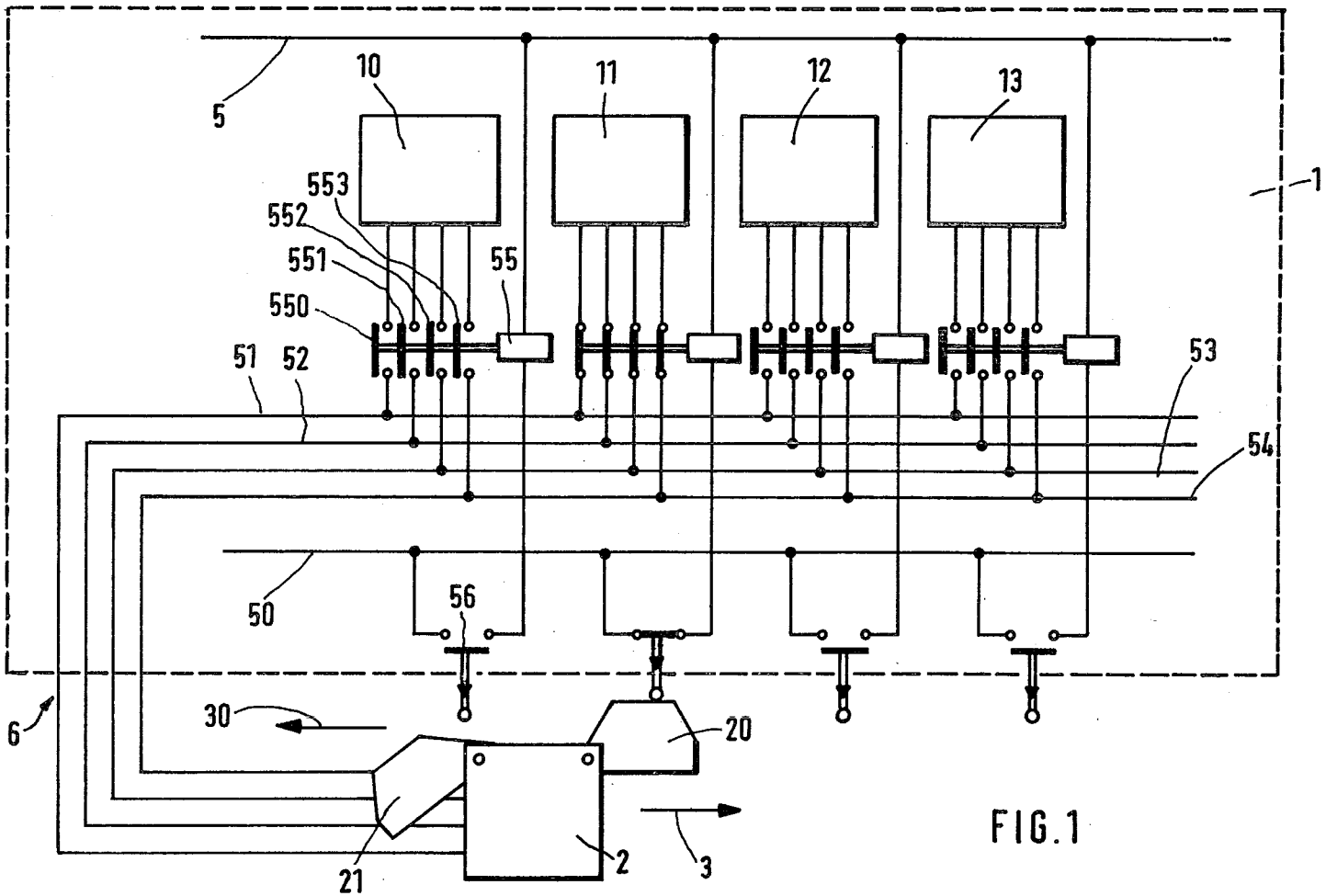
FIG. 1 shows a diagrammatic representation of the subject of the invention.
Figure 2:
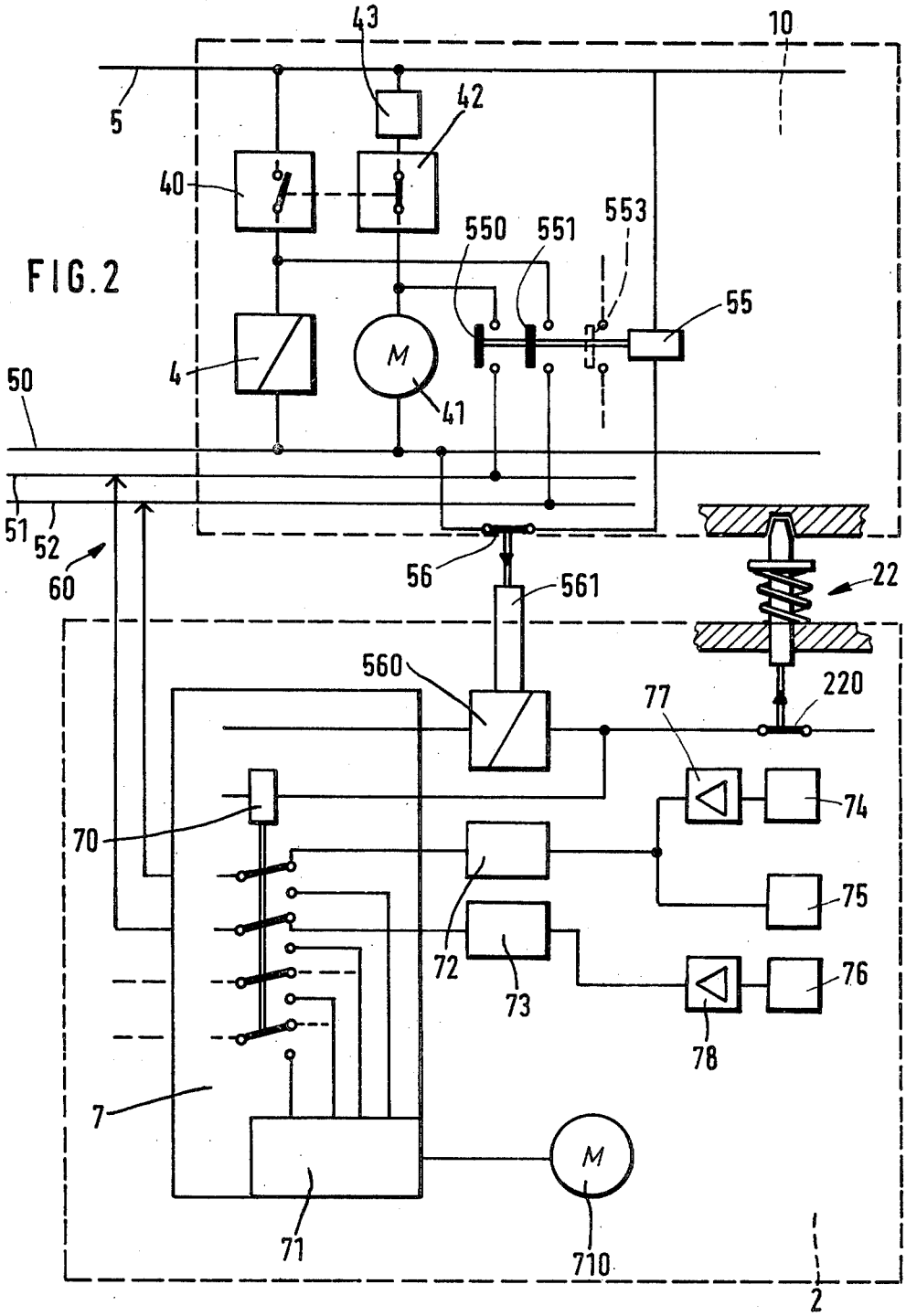
FIG. 2 shows, in a diagram, an exemplary embodiment of two-way utilization of the transmission lines between the spinning machine and maintenance device.

FIG. 1 illustrates diagrammatically a spinning machine 1, along which a maintenance device 2 is movable alternately in the direction of the arrows 3 and 30. The spinning machine possesses a plurality of spinning units, four spinning units 10, 11, 12 and 13 of which are illustrated. Each spinning unit 10, 11, 12 and 13 possesses a plurality of elements which are to be controlled electrically. Thus, for example, there is for each spinning unit a control magnet 4 (FIG. 2) for the fiber feed which is controlled by a thread regulator 40. A length counter (not shown) for the bobbin can also be provided for counting the thread length wound onto it, so that when a specific size of bobbin has been reached, measured in length of thread, the bobbin can be replaced by an empty tube. A moire detector (likewise not shown) can also be provided for each spinning unit, and this controls the magnet 4 for the fiber feed when a certain tolerance limit is exceeded. For each spinning element, for example a spinning rotor, there can also be an individual drive motor 41. In the exemplary embodiment illustrated, a switch 42, which is coupled to the thread regulator 40 and via which the drive motor 41 can be connected to a frequency transmitter 43 controlling its speed, is assigned to the drive motor. Further elements to be controlled electrically can also be provided.

Along the spinning machine 1 extend bus lines 5, 50, 51, 52, 53 and 54 which serve either for the normal current supply (bus lines 5 and 50) or as a control connection (bus lines 51 to 54) between the individual spinning units 10, 11, 12 and 13 and the maintenance device 2. For this purpose there are trailing cables 6 (see FIG. 1) or sliding contacts 60 (FIG. 2) via which the maintenance device 2 is connected constantly to the bus lines 51, 52, 53 and 54.

The individual spinning units 10, 11, 12 and 13 can be connected respectively to the bus lines 51, 52, 53 and 54 via the contacts 550, 551, 552 and 553 of a switching device 55, for example, by a relay. Each switching device 55 is in series with a switch 56, upon the closing of which the switching device 55 closes its contacts 550, 551, 552 and 553 and thus makes the connection between the corresponding spinning unit 10, 11, 12 or 13 and the maintenance device 2. To actuate the switch 56, there is on the maintenance device 2 a first control cam 20 which, when it approaches a spinning unit 10, 11, 12 or 13 in the direction of the arrow 3, closes the switch 56.

When the maintenance device 2 travels along the spinning machine 1 in the direction of the arrow 30, at the time of a change in direction of the maintenance device 2 the control cam 20 is brought, as a result of pivoting, into its inoperative position and a control cam 21 is brought into the working position. Further details will be explained later. The two control cams 20 and 21 are located on opposite sides of the maintenance device 2 and can be put alternately into and out of the working position in such a way that the leading control cam 20 or 21, respectively, is always effective.

The maintenance device 2 possesses a control device 7 which has, among other things, a change-over device 70. This change-over device 70 connects the particular spinning unit 10, 11, 12 or 13 cut in either to a control device 71 for the travel-drive motor 710 of the maintenance device 2, or else to control devices 72 and 73 for evaluating the signals called up from the cut-in spinning unit 10, 11, 12 or 13 and for connection to program transmitters 74, 75 or 76 for subsequent control of this spinning unit. For this purpose, the program transmitters 74, 75 and 76 are connected to the control devices 72 and 73, and, if required, an amplifier 77 or 78 can be interposed respectively between them.

The maintenance device 2 also possesses a centering device 22 which, when it has reached its final working position in relation to a spinning unit 10, 11, 12 or 13, actuates a switch 220 which itself actuates a magnet 560, the armature 561 of which serves for actuating the switch 56 and the change-over device 70.

The functioning of the subject of the invention will be described below, assuming that the maintenance device 2 travels along the spinning machine 1 in the direction of the arrow 3. In the initial position of the maintenance device 2 at the end of the machine, none of the switches 56 is actuated, so that the maintenance device 2 is also not connected to any of the spinning units 10, 11, 12 and 13. When the leading control cam 20 serving as an actuating device for the switching device 55 reaches the switch 56 of the first spinning unit (for example, the spinning unit 10), the switching device 55 is excited. Consequently, as a result of the closure of its contacts 550, 551, 552 and 553, this connects the particular spinning unit 10 to the maintenance device 2.

When, by evaluating the signals from the spinning unit 10, the control device 7 establishes that it is working perfectly, the maintenance device 2 runs further to the next spinning unit 11 without an intermediate stop, that is to say without interrupting its travel. However, should this evaluation by the control device 7 indicate that any one of the monitored elements is transmitting an incorrect signal, then via the change-over device 70, the control device 71 for the travel-drive motor 710 of the maintenance device 2 is cut in, and this causes the maintenance device 2 to be braked until the switch 220 is closed by the centering device 22 when the exact working position in relation to the spinning unit 10, 11, 12 or 13 has been reached. This switch 220 insures that the switch 56, which has meanwhile been released again by the maintenance device 2 moving further, is actuated again by the armature 561 of a magnet 560 which now responds, and causes the switching device 55 to be excited. At the same time, the change-over device 70 in the maintenance device 2 is switched over so that the signals now sensed from the spinning unit are fed to the control devices 72, 73, etc.

If, for example, a thread break has occurred, the control magnet 4 will have been activated as a result of closure of the thread regulator 40. The control magnet 4 thus causes an interruption in the supply of fiber to the spinning element. At the same time, the drive motor 41 of the spinning element is stopped via the switch 42 coupled to the thread regulator 40.

When the thread regulator 40 is in its closed state and current therefore flows through the control magnet 4, a low voltage potential is present on the bus line 51 connected to the control magnet 4 via the contact 550. This means for the control device 72 that the thread regulator 40 has previously been activated. If, however, the thread regulator 40 is in its open operating state, this is expressed by the fact that a potential equal to the control voltage for the control magnet 4 is present on the bus line 51. This means to the control device 72 that there is no thread break.

In a similar way, the frequency preset for the drive motor 41 is signalled to the control device 73 via the contact 551 and the bus line 52.

If the thread break is eliminated by means of the control device 7 in a way known per se by the maintenance device 2, the maintenance device 2 can control synchronously therewith an increase in the speed of the spinning element up to its operating speed, if appropriate with temporary switching-on of a lower thread-joining speed, and the cutting-in of the fiber feed. To control the speed of the spinning element, the program transmitter 76 designed as a frequency transmitter is cut in at the desired moment in time via the control device 73 and presets for the drive motor 41, via the bus line 52, the required frequency corresponding to the desired speed. The fiber feed is controlled in a similar way by supplying, via the control device 72 and the program transmitter 74, a voltage potential of zero to the control magnet 4 for the time during which the latter is to prevent the fiber feed, whilst to cut in the fiber feed by connecting a voltage potential at the level of its operating voltage (program transmitter 75), in spite of a closed thread regulator 40, the control magnet 4 does not conduct current since this is supplied from the maintenance device 2.

When elimination of the thread break has been completed, the magnet 560 drops under the influence of the control device 7. The switch 56 is released and the spinning unit 10, 11, 12 or 14 works independently again.

Before the spinning unit 10, 11, 12 or 13 is separated electrically from the maintenance device 2, a check of the spinning unit can, of course, be carried out by the control device 7, so as to ascertain whether elimination of the thread break or any other correction made has been successful so that, if appropriate, the correction can be repeated. For this purpose, the switch 56 is either actuated again from the control device 7 or else is kept pressed closed during the entire thread-joining operation (see FIG. 2). After the thread-joining operation has been concluded, an interrogation is made via the switch 56 as to whether the thread regulator 40 is in its closed operation state, that is to say whether it has been possible to eliminate the thread break or not. If the thread regulator 40 registers the normal thread tension, the maintenance device 2 moves further; if this thread tension is lacking, the maintenance device 2 repeats the thread-joining operation.

In all this, thread joining is carried out in a way conventional per se and, if desired, also includes cleaning of the spinning element, special preparation of the thread end, etc.

Figure 3:
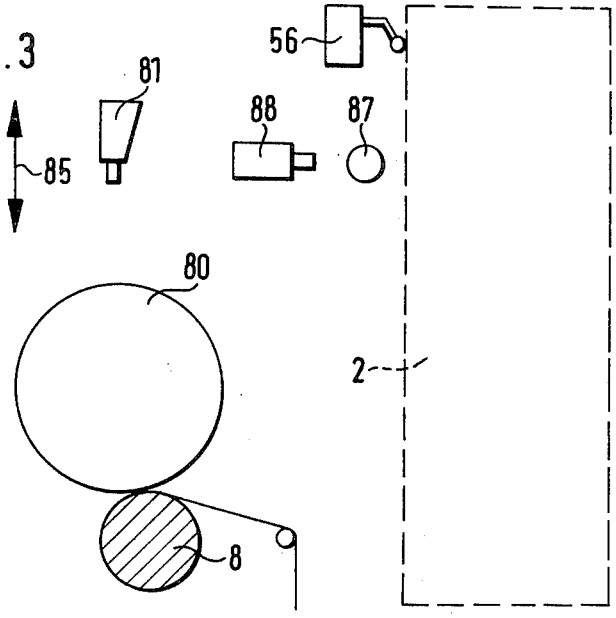
FIGS. 3 and 4 show, in side views, a winding-on mechanism with a bobbin-monitoring device.

An exemplary design of the bobbin-monitoring system is described below with reference to FIGS. 3 and 4. FIG. 3 shows a full bobbin 80 which is supported on a spooling roller 8 and is driven thereby. A sensing unit 81 is arranged diametrically opposite the spooling roller 8 in relation to the bobbin 80. This sensing unit 81 contains a light barrier (not shown) and a photo cell (not shown) which registers the light beam reflected by the bobbin 80 and which transmits a control pulse according to the intensity which depends on the bobbin size. Here, in the design illustrated, the sensing unit 81 is adjustable radially to the bobbin 80 according to the desired size of the bobbin 80 (see arrow 85).

Figure 4:
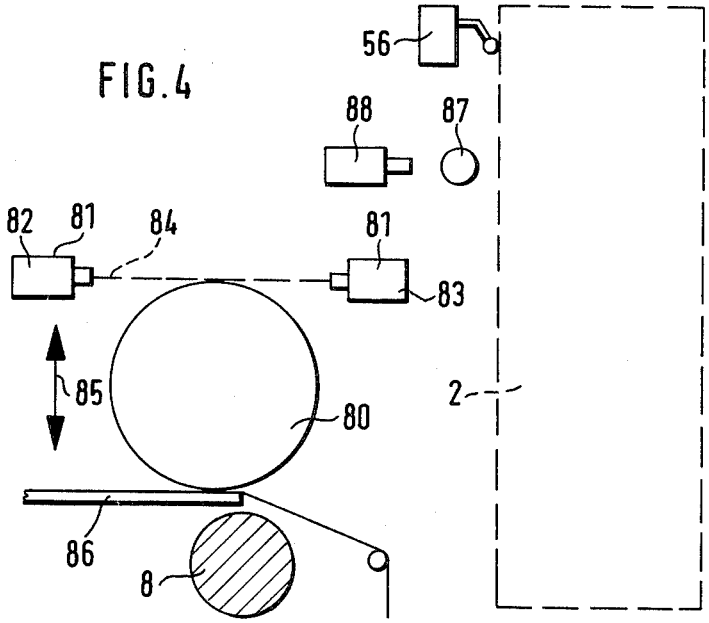

FIG. 4 shows another design of the bobbin-sensing system, according to which the sensing device 81 consists of a light source 82 and a photo cell 83 located separately therefrom. The light barrier 84 extending from this light source 82 to the photo cell 83 is arranged transversely to the lifting direction (see arrow 85) of the bobin 80. In the design shown, this light barrier 84 is adjustable in the direction of the arrow 85 so that the bobbin change can be carried out with different bobbin diameters. As shown in FIG. 4, assigned to the bobbin 80 is a bobbin support element 86 which can separate the bobbin 80 from its spooling roller 8 and thus stop it.

Like the signals from other monitored devices of the spinning unit 10, 11, 12 or 13, the signals from the sensing device 81 are also conducted via the switch 56.

Depending on whether the sensing device 81 or the thread regulator 40 each respond on their own or whether the sensing device 81 and the thread regulator 40 respond together, the following working situations arise:

(a) Neither the sensing device 81 nor the thread regulator 40 is activated on a spinning unit 10, 11, 12 or 13. In that case, the maintenance device 2 travels past this spinning unit 10, 11, 12 or 13.
Neither a thread break has occurred nor has the bobbin 80 reached the bobbin diameter envisaged.

(b) The sensing device 81 is activated, but the thread regulator 40 is not. The maintenance device 2 stops, since the envisaged bobbin diameter has, of course, been reached, even when no thread break has occurred. The maintenance device 2 insures, in a way known per se, that the fiber feed to the spinning element is discontinued by actuating the control magnet 4 (FIG. 2) on the spinning unit 10, 11, 12 or 13. A thread break occurs as a result, so that the thread regulator 40 also responds, and this insures that the bobbin support element 86 is impelled in a way known per se between the bobbin 80 and its spooling roller 8 so as to stop the bobbin. A bobbin change is now carried out in a way known per se, and the thread is joined, the bobbin support element 8 being pushed back into its position of readiness.

(c) The sensing device 81 has not been activated, but only the thread regulator 40. This means that a thread break has occurred, but the bobbin 80 has not yet reached its desired diameter. The maintenance device 2 therefore stops in order to eliminate the thread break by rejoining the thread.

(d) Both the sensing unit 81 and the thread regulator 40 have been activated. The maintenance device 2 stops and joins the thread. Then, when, after the bobbin 80 has been released by the bobbin support element 86, the bobbin 80 comes to rest against its spooling roller 8 again, the sensing unit 81 interrogates as to whether the desired bobbin diameter has been reached or not. Only depending on this interrogation after thread-joining is a bobbin change carried out, if appropriate. It must be remembered, here, that because the bobbin 80 has been lifted by the bobbin support element 86 as a result of the thread break which has occurred the bobbin approaches the sensing unit 81 or the light barrier 84, so that incorrect facts are simulated in the latter. For this reason, the maintenance device 2 utilizes only the signal which is transmitted by the spinning unit 10, 11, 12 or 13 when the bobbin 80 rests against the spooling roller 8.

So that the maintenance device does not stop needlessly at a spinning unit 10, 11, 12 or 13 so as to carry out a bobbin change even though there is no empty tube 87 ready, in the design illustrated in FIGS. 3 and 4, respectively, there is on each spinning unit 10, 11, 12 and 13 a further sensing unit 88 which can likewise be connected via the switch 56 to the maintenance device 2. This sensing unit 88 is arranged so that it detects whether there is at the particular spinning unit 10, 11, 12 or 13 an empty tube 87 in the position of readiness or not and whether a bobbin change can therefore be carried out here or not. When the two sensing units 81 and 88 are activated, the maintenance device 2 stops, produces a thread break, subsequently eliminates this and then carries out a bobbin change. If the sensing unit 88 is not activated, but only the sensing unit 81, then maintenance device 2 travels past this spinning unit 10, 11, 12 or 13.

To prevent the bobbin 80 from continuing to become larger after the desired bobbin diameter has been reached, because there is no empty tube 87 ready, it is envisaged, in a further embodiment that the maintenance device 2 should remain standing for a short time at the particular spinning unit 10, 11, 12 or 13, so as to produce a thread break by actuating the control magnet 4 and stop the bobbin 80 as a result of the resulting actuation of the bobbin support element 86. If appropriate, the control magnet 4 can even be actuated without interrupting the travel of the maintenance device 2.

The actuating device, which according to the design described possesses two control cams 20 and 21, which can be activated alternately, and an armature 561, can be made in various ways. If there is only a single direction of rotation 3 or 30 of the maintenance device 2 around the spinning machine 1, then a single control cam 20 or 21, respectively, is sufficient. If, on the other hand, the maintenance device 2 travels up and down along one side of the spinning machine 1 like a shuttle, it may be sufficient to provide a single suitably long control cam which actuates the switch 56 even before a spinning unit 10, 11, 12 or 13 is reached, and until this is left behind, the transmission of control commands to the spinning unit being controlled as a function of the centering device 22. However, there can also be two reversible control cams 20 and 21 which are changed over when the direction of rotation of the maintenance device 2 is reversed. The signals can be stored in a memory in the maintenance device 2 until they are called up again during actuation by the centering device 22 and initiate the transmission of control signals. However, the control cams 20 and 21 can also have such a length that they still interact with the switch 56 even in the working position. The control cams 20 and 21 can be changed over during the reversal of the direction of rotation of the travel-drive motor 710 or else by means of a stop (not shown) at the end of the machine, which brings the control cams arranged in the manner of a rocker on a common lever into their other switch position where they are secured by an engaging device, etc.

The centering device 22 can also be designed itself as an actuating device and thus render the magnet 560 together with its armature 561 superfluous. Nor is it absolutely necessary to actuate the switch 56 mechanically, but it can be designed as an induction switch, light barrier, etc., to which a corresponding switching lug (possible as a reflector for the light barrier) on the maintenance device 2 is assigned as an actuating device. If appropriate, the length of this can also be adjustable, if this happens to be advantageous for any reason.

The centering device 22 can also work with no contact, for example, by means of a light barrier, or can be combined with one of these, so that, for example, a light barrier carries out the preliminary adjustment and a mechanical device the precision adjustment.

In the exemplary embodiment described, the bus lines 51, 52, 53 and 54 serve for the transmission of signals from the spinning unit 10, 11, 12 and 13 to the evaluation devices (control devices 72, 73) of the maintenance device 2 and also from their control devices (program transmitters 74, 75, 76) to the spinning unit. Depending on the design of the elements (4, 41) to be controlled of the spinning units 10, 11, 12 and 13 and of the maintenance device 2, it is also possible or even necessary to provide separate bus lines 51, 52, 53 and 54 for the interrogation of signals by the maintenance device 2 and for the transmission of control signals by the maintenance device 2. The design chosen in the examplary embodiment illustrated is, however, especially advantageous. It is made possible because the linking of the bus lines 51, 52, 53 and 54 with the elements (control magnet 4, drive motor 41) to be controlled takes place respectively between this element and the associated switching element (thread regulator 40, switch 42). If necessary, measures suitable for limiting the current of the switching elements (40, 42) can be provided as overload protection.

The frequency transmitter 43 for the drive motors 41 of all the spinning units 10, 11, 12 and 13 can also be located centrally in the spinning machine 1, and the switch 42 can be designed as a change-over switch which connects the drive motor 41 either to the frequency transmitter 43 or to the bus line 50.

The invention also makes it possible, if desired, to switch the elements 4, 41 to be controlled on and off several times from the maintenance device 2.

The invention is not restricted to the design described, but also embraces solutions in which individual features are replaced by equivalents, interchanged or combined with one another.

What is claimed is:

1. An apparatus for use on an open-end spinning machine and the like of the type having a plurality of spinning units, a plurality of electrically controlled operating elements associated with each of said spinning units, a maintenance device movable along the spinning machine which has an electrical power source which can be coupled to the electrical operating elements of a particular spinning unit for supplying electrical power to the operating elements, said apparatus comprising:

a plurality of electrical bus lines;

a separate one of said bus lines associated with each one of said operating elements of each of said spinning units to electrically control said one operating element;

a switching means associated with each spinning unit actuated in response to said maintenance device arriving at a working position in front of said spinning unit;

said switching means connecting said electrically controlled operating elements of a spinning unit with respective ones of said electrical bus lines when said maintenance device is at said working position so that said spinning unit is connected-in electrically; and said maintenance device being constantly connected to said bus lines as it moves from one spinning unit to another as required for maintenance.

2. The apparatus as set forth in claim 1 further comprising:

said maintenance device including a number of evaluation devices for evaluating signals from the spinning unit which is connected-in electrically with said maintenance device when said maintenance device is at said working position;

said maintenance device including a number of control devices for subsequently controlling said connected-in spinning unit; and means for alternately connecting said bus lines to said evaluation devices or to said control devices.

3. The apparatus as set forth in claim 1 further comprising:

an actuation means carried by said maintenance device which advances before said maintenance device advances in the direction of movement for activating said switch means.

4. The apparatus as set forth in claim 1 further comprising:

said actuation means including an actuating device on each side of said maintenance device which leads said maintenance device in the direction of movement of said maintenance device; and means for alternately moving said leading actuating device into and out of operation in response to a change in the direction of movement of said maintenance device.

5. The apparatus as set forth in claim 3 further comprising:

a second actuating means actuating said switching means which is activated in response to said maintenance device arriving at said working position.

6. The apparatus as set forth in claim 1 wherein said electrically controlled operating elements of each said spinning units includes:

an individual drive motor being connected by said switching means to a connecting line;

a second switching means connected in said connecting line; and a drive motor control device connected in said connecting line with said drive motor by way of said second switching means.

7. The apparatus as set forth in claim 6 comprising:

a thread monitor operatively coupled with said second switching means.

8. The apparatus as set forth in claim 6 wherein said first switching means and said second switching means are provided in the form of a switching-over device for alternately connecting said drive motor with one of said control devices.

9. The apparatus as set forth in claim 6 wherein said control devices include a frequency transmitter.

10. The apparatus as set forth in claim 6 wherein one of said drive motor control devices is disposed centrally in the spinning machine.

11. The apparatus as set forth in claim 8 wherein one of said drive motor control devices is located on the maintenance device.

12. The apparatus as set forth in claim 1 comprising:

a control device located in the maintenance device;

a thread monitor;

said electrically controlled operating elements of each of said spinning units including a control magnet connectable by said thread monitor with one of said bus lines; and said control device being coupled by said switching means with a connecting line between said control magnet and said thread monitor.

13. The apparatus as set forth in claim 11 wherein said control device for said control magnet comprises two programmed transmitters which can be switched on alternately for subsequent control of the spinning unit.

14. The apparatus as set forth in claim 1 comprising:

a travel drive motor for driving the maintenance device in its movement along said spinning machine;

travel motor control means for controlling said travel drive motor;

a plurality of control devices for controlling said electrically controlled operating elements; and a switch-over device carried on said maintenance device for switching between said travel motor control means and said control devices for said operating elements.

15. An apparatus for use on a spinning machine such as an open-end spinning machine of the type having a plurality of spinning units, a plurality of electrically controlled operating elements associated with each spinning unit for controlling the operation of said spinning units, a winding device having a bobbin and a thread monitor, and a maintenance device which is movable along the spinning machine which can be electrically coupled to the operating elements of each spinning unit to control the coupled spinning unit in a working position, said apparatus comprising:

sensing means associated with said bobbin for sensing a condition of said bobbin;

a bobbin changing device located on said maintenance device;

said sensing means being connected with said bobbin changing device for controlling said bobbin changing device;

a bobbin support means associated with said bobbin;

a thread monitor controlling said bobbin support means to stop the bobbin; and said maintenance device controlling said bobbin support means to start said bobbin.

16. The apparatus as set forth in claim 15 wherein said sensing means includes a light barrier.

17. The apparatus as set forth in claim 15 wherein said sensing means is displaceably mounted in relation to said bobbin so that a variety of bobbin diameters may be accommodated and sensed by said sensing means.

18. The apparatus as set forth in claim 15 wherein said sensing means is located on said maintenance device and is adapted to be associated with each of said spinning units as said maintenance device is in said working position.

19. The apparatus as set forth in claim 15 wherein said sensing means is stationarily located at each of said spinning units, said sensing means included as one of said electrically controlled operating elements of each spinning unit.

20. The apparatus as set forth in claim 15 comprising second sensing means at each of said spinning units for sensing empty tubes being in a position of readiness for thread winding thereon.

* * * * *